United States Patent [19]

Rauschert et al.

[11] 4,294,172

[45] Oct. 13, 1981

[54] PROJECTILE WITH RECOVERABLE DETONATOR

[75] Inventors: Willi Rauschert, Altensittenbach; Gerald Rieger; Erich Bock, both of Nuremberg; Alfred Eckel, Treuchtlingen, all of Fed. Rep. of Germany

[73] Assignee: Diehl GmbH & Co., Fed. Rep. of Germany

[21] Appl. No.: 43,133

[22] Filed: May 29, 1979

[30] Foreign Application Priority Data

Jun. 2, 1978 [DE] Fed. Rep. of Germany ..... 2824203

[51] Int. Cl.[3] ..... F42B 11/22

[52] U.S. Cl. ..... 102/473; 102/357; 102/275.9; 102/364; 102/498; 102/513; 102/529

[58] Field of Search ..... 102/92.6, 34.4, 35.6, 102/37.6, 4, 56, 87

[56] References Cited

U.S. PATENT DOCUMENTS

| | | | |
|---|---|---|---|
| 2,834,293 | 5/1958 | Beach et al. | 102/35.6 X |
| 3,513,777 | 5/1970 | Hannold | 102/34.4 X |
| 3,719,145 | 3/1973 | Brown | 102/35.6 |
| 3,765,336 | 10/1973 | Kulsik | 102/87 |
| 3,791,300 | 2/1974 | Prochnow | 102/87 X |
| 3,839,962 | 10/1974 | Popovitch | 102/56 |
| 4,023,495 | 5/1977 | Fischer | 102/35.6 |

*Primary Examiner*—Harold J. Tudor

*Attorney, Agent, or Firm*—Scully, Scott, Murphy & Presser

[57] ABSTRACT

A projectile which includes a detonator recoverable to provide function control. A projectile upper portion fitted on a projectile shell carries the detonator. An aerodynamic brake arrangement is located within the projectile shell. A ram supported in the projectile shell has an ejector charge arranged adjacent thereto at the side opposite the projectile upper portion.

6 Claims, 3 Drawing Figures

FIG. 1
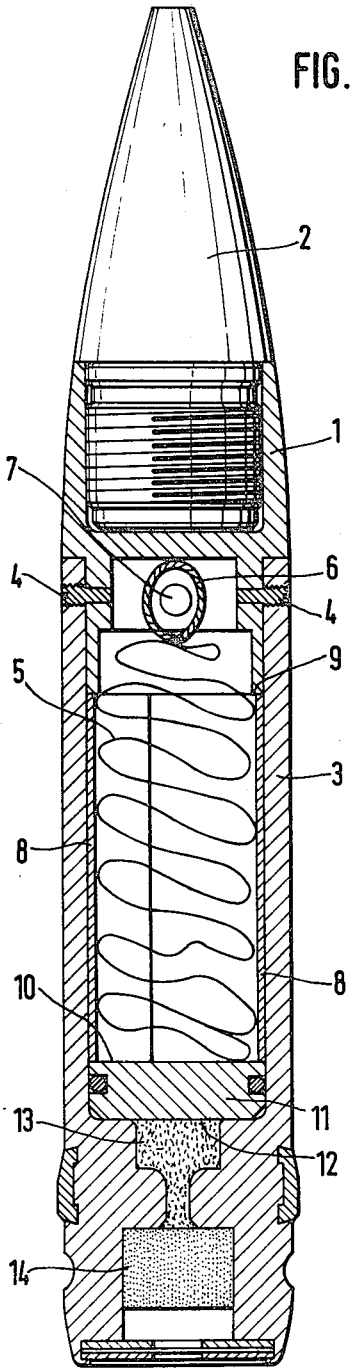
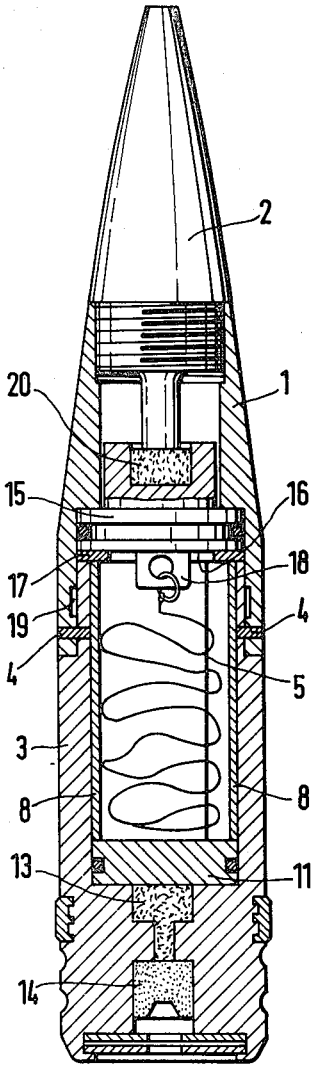
FIG. 2

PROJECTILE WITH RECOVERABLE DETONATOR

BACKGROUND OF THE INVENTION

Field of the invention

The present invention relates to a projectile including a detonator which is recoverable to provide for function control.

Extremely high demands are set upon the dependability of the detonators. As a result, also such defects or faults must be determined which occur at only a low rate of failure. Not all operating conditions can be so exactly simulated on test installations to enable the detection of defects occurring at a low rate of failure. For example, in particular the electronic components of a detonator are subject to loads during firing or discharge which can hardly be simulated on test installations.

SUMMARY OF THE INVENTION

Accordingly, it is an object of the present invention to propose a projectile which facilitates the investigation of a detonator subject to misfiring.

The foregoing object is inventively attained in that, fastened to the detonator-carrying projectile top or upper portion which is mounted on a projectile shell, is an aerodynamic brake arrangement located interiorly of the projectile shell, and wherein there is located an ejector charge in the projectile shell on the side of a ram supported in the projectile shell which is facing away from the projectile upper portion. The ejector charge is detonated after the discharge of the projectile and then pushes the projectile upper portion, together with the detonator, away from the projectile shell. Thereafter, the aerodynamic brake arrangement which for instance, may be constituted of a brake band, brake cords, or a drag parachute, is rendered effective. The projectile upper portion will then slowly descend. Hereby, it is advantageous that the detonator which is to be tested actually subjected to a firing or discharge conforming to that in actual practice and that there can be tested the effects of the discharge on the detonator components. Test installations which can simulate the discharge only more or less exactly are eliminated.

In a preferred embodiment of the invention, the ram impacts against the projectile upper portion through the intermediary of half shells which encompass the brake arrangement. Thereby, on the one hand, the brake arrangement is so arranged as to unfold with assurance subsequent to the ejection of the projectile upper portion and, on the other hand, the explosion pressure of the ejector charge will securely act on the upper portion through the ram.

In a preferred modified embodiment of the invention, provided in the projectile upper portion is a further ejector charge on the side of a further ram facing away from the projectile shell and which located in the projectile upper portion. This further ejector charge can be ignited by the detonator itself, for example, when the detonator is a proximity fuse so that, after the descent of the detonator, tests can be conducted as to whether the desired functions were carried out. The term "detonator" employed throughout the application also contemplates fuses which are essentially detonators possessing generally mechanical, electrical members rather than exclusively pyrotechnical members.

BRIEF DESCRIPTION OF THE DRAWINGS

Further advantageous embodiments of this invention may now be ascertained from the following detailed description of the projectile, taken in conjunction with the accompanying drawings; in which:

FIG. 1 is a partially sectioned longitudinal view of a projectile with a recoverable detonator;

FIG. 2 is a second embodiment of the projectile; and

DETAILED DESCRIPTION

Figure 3:
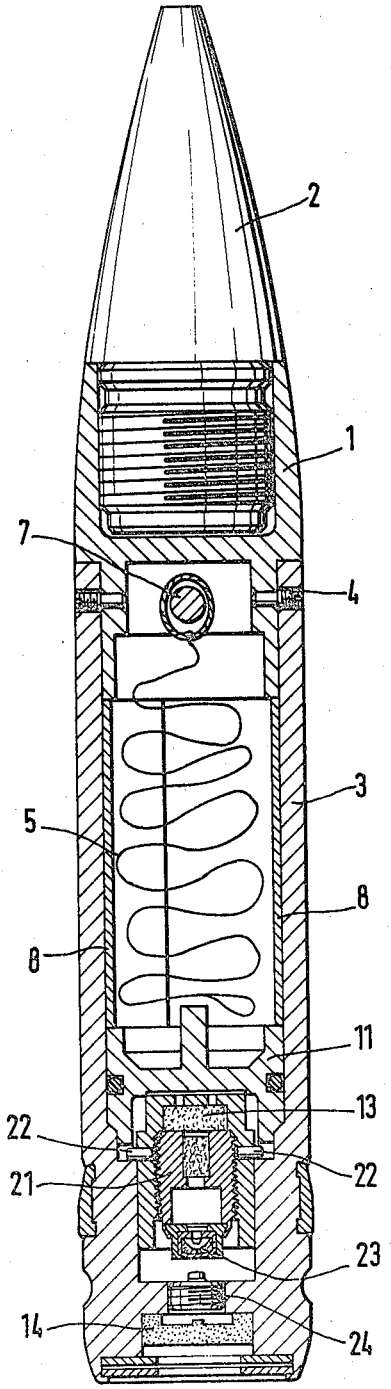
FIG. 3 is a third embodiment of the projectile constructed pursuant to the invention.

Arranged in a projectile upper portion 1 is a detonator 2, not shown in closer detail. The projectile upper portion 1 is fitted on a projectile shell or cartridge 3. Both components are secured to each other by means of shearable pins 4.

A schematically illustrated braking means 5 lies folded within the shell 3, and is fastened through a loop 6 to a mounting pin 7 in the projectile upper portion. The braking means 5 may be a brake band, brake cords or a drag parachute. The brake band 5 is encompassed by two half shells 8 which are slidably supported within the projectile shell 3. The half shells 8 lie at one end, against an edge 9 of the projectile upper portion 1 and at the other end, against the surface 10 of a piston or ram 11. The ram 11 is also slidable within the projectile shell 3. Arranged in the projectile shell 3 on the side 12 of the ram 11 opposite the surface 10 is an ejector charge 13. This charge is in communication with a tracer charge 14.

The manner of operation of the described projectile is, in general, as follows:

After the firing or discharge of the projectile, the tracer charge 14 burns down. When this charge has extensively burned down, it will ignite the ejector charge 13. In lieu of the tracer charge 14 there can also be provided another type of pyrotechnic charge which, after the discharge, will delayedly lead to an ignition or destruction of the ejector charge 13. Through the explosion pressure of the ejector charge 13, the ram 11 presses by means of the half shells 8 against the projectile upper portion 1. The pins 4 will thus shear and the projectile upper portion 1 detaches itself from the projectile shell 3. The brake band 5 unfolds and leads to a relatively slow descent of the projectile upper portion. As a result of the construction of the components 8 as half shells, attained is that the unfolding of the brake band will not be hindered. In lieu of the brake band there can also be utilized brake cords, a drag parachute or other devices which will increase the air resistance of the projectile upper portion after the separation thereof from the projectile shell.

The brake band is conspicuously colored so that the projectile upper portion 1, together with the detonator 2, can be easily found on the terrain. Thereafter, the detonator 2 can be examined as to whether any kind of breakdowns were caused through the discharge.

The configuration and manner of operation of the exemplary embodiment pursuant to FIG. 2 corresponds to that described herein above. Additionally, in the embodiment of FIG. 2 there is provided a further ram 15 which is slidably supported in the projectile upper portion 1. Arranged between the half shells 8 and the surface 16 of the ram 15 is a snap ring 17 which is under tension. An eyelet 18 is provided on the surface 16, to which there is fastened the brake band 5. An annular groove 19 is formed on the projectile upper portion 1, into which there can engage the snap ring 17.

A further ejector charge 20 is located against the side 15 of the ram lying opposite the surface 16, and is adapted to be ignited by the detonator 2 itself.

The manner of operation of the further ram 15, in essence, the further ejector charge 20, is generally as follows:

The detonator 2 is, for example, a proximity fuse. When the proximity fuse correctly determines a target approach criteria after the discharge of the projectile, it detonates the ejector charge 20. Thereby the projectile upper portion is drawn off from the projectile shell by means of the ram 15, whereupon the pins 4 will shear. At the relative movement between the projectile upper portion 1 and the piston 15, the snap ring 17 will engage into the annular groove 19, causing the ram 15 to be arrested on the projectile upper portion 1. The projectile upper portion can now descend while being braked through the brake band 5. After the landing, the detonator 2 can then be examined.

In the event that the detonator does not correctly detect the approach criterium, the separation of the projectile upper portion 1 and the projectile shell 3 after the burning down of the tracer charge 14 is effected through the detonation of the ejector charge 13.

In the projectile pursuant to FIG. 3, the ejector charge 13 is arranged in an ejector element 21. Prior to discharge, the ejector element 21 is secured to the projectile 3 by means of shear pins 22. At the discharge of the projectile, the shear pins 22 are sheared under the effect of the mass moment of inertia of the ejector element 21, and a primer cap 23 of the ejector element 21 strikes again a firing pin 24, which ignites the tracer charge 14.

After completion of the combustion period of the tracer charge 14, the ejector charge 13 is detonated. The resulting combustion gases relatively slowly escape across the ram 11, detonator 2, and brake band from the projectile.

Through the predetermined ignition of the tracer charge 14 it is possible to precisely maintain the desired time points for the ejection of the detonator 2.

In a further embodiment of the invention, a small explosive charge can be arranged in the projectile upper portion 1. Through this there can be achieved that only duds will be removed.

We claim:

1. Projectile including a detonator (2) recoverable to provide function control, wherein an aerodynamic brake arrangement (5) located interiorly of the projectile body (3) is mounted on a projectile upper portion (1) supporting the detonator (2) and which is fastened to the projectile body (3), and a piston (11) is supported within the projectile body (3) which propels the projectile upper portion (1) out of the projectile body (3) at the ignition of apropellant charge (13), characterized in that the projectile body is formed by a projectile shell (3), the propellant charge (13) is arranged in the projectile shell (3) at the side of the piston (11) facing away from the projectile upper portion (1), and the piston (11) impacts against and the projectile upper portion (1) through half-shells (8) which extend about the brake arrangement (5), ram means being arranged in said projectile upper portion said ram means having a limited path of movement, and said brake means being fastened thereto; a further ejector charge in said upper portion being located against the side of said ram means opposite the projectile shell (3), and said ejector charge being detonated by said detonator (2).

2. Projectile as claimed in claim 1, comprising a tracer charge, said ejector charge detonating subsequent to the to the burning down of said tracer charge.

3. Projectile as claimed in claim 1, comprising shearable pins interconnecting said projectile upper portion and said projectile shell.

4. Projectile as claimed in claim 1, said brake means comprising a brake band.

5. Projectile as claimed in claim 1, said brake means comprising brake cords.

6. Projectile as claimed in claim 1, said brake means comprising a drag parachute.

* * * * *